United States Patent [19]

Sakashita

[11] Patent Number: 4,648,115

[45] Date of Patent: Mar. 3, 1987

[54] PAN-POT CONTROL APPARATUS

[75] Inventor: Shigeo Sakashita, Tokyo, Japan

[73] Assignee: Casio Computer Co., Ltd., Tokyo, Japan

[21] Appl. No.: 649,500

[22] Filed: Sep. 11, 1984

[30] Foreign Application Priority Data

Sep. 22, 1983 [JP] Japan ..... 58-174060

[51] Int. Cl.[4] ..... H04R 5/00

[52] U.S. Cl. ..... 381/17; 381/18; 84/DIG. 26

[58] Field of Search ..... 381/61, 62, 63, 17, 381/18, 19; 84/DIG. 26, 1.24

[56] References Cited

U.S. PATENT DOCUMENTS 3,761,631 9/1973 Ito et al. ..... 381/18
4,002,836 1/1977 Gardner ..... 338/143 X

FOREIGN PATENT DOCUMENTS 0036337 9/1981 European Pat. Off. .
856232 12/1952 Fed. Rep. of Germany .
8501177 3/1985 World Int. Prop. O. .
695435 8/1953 United Kingdom .
772253 4/1957 United Kingdom .
2008904 6/1979 United Kingdom .
1549292 7/1979 United Kingdom .

OTHER PUBLICATIONS

Chowning, "The Simulation of Moving Sound Sources," Computer Music Journal, Jun. 1977.
Elekor, May 1979, pp. 5-40 to 5-46.
Patents Abstracts of Japan, E-51, Apr. 10, 1981, vol. 5/No. 51.
Patents Abstracts of Japan, E-153, Jan. 19, 1983, vol. 7/No. 13.

*Primary Examiner*—Forester W. Isen
*Attorney, Agent, or Firm*—Frishauf, Holtz, Goodman & Woodward

[57] ABSTRACT

An input musical tone signal is amplified by a first VCA and then supplied to second and third VCAs. The second and third VCAs are controlled by sine-wave signals which have a 180°-phase difference. Musical tone signals, which have been so controlled that a pan-pot may move right and left, are supplied to right and left loudspeakers. The first VCA is controlled by a sine-wave signal whose phase is different by 90° from the phases of the signals supplied to the second and third VCAs. The volume of a composite musical tone made up of the tones generated by the loudspeakers is thereby controlled, thus also moving the pan-pot to the front and rearward.

27 Claims, 7 Drawing Figures

PAN-POT CONTROL APPARATUS

BACKGROUND OF THE INVENTION

The present invention relates to a pan-pot control apparatus.

To generate a musical tone, one tone signal is supplied from a tone signal generator to voltage controlled amplifiers, and the outputs of these amplifiers are input to right and left loudspeakers. In this case, a pan-pot device may be used to change the outputs of the amplifiers such that the total value remains constant, whereby the loudspeakers generate a musical tone which sounds as if it comes from a point moving along the line connecting the loudspeakers. The musical tone, however, sounds monotonous; it is not dynamic.

In order to make the musical tone dynamic, the loudspeakers may be rotated. For the same purpose a fan may be provided in front of each loudspeaker. If the loudspeakers are rotated or fans are used, the musical tone generating system will inevitably become complex, and its cost will rise; yet the musical tone can vary only a little.

SUMMARY OF THE INVENTION

The object of this invention is to provide a pan-pot control apparatus which is simple in construction and can yet serve to generate a rich, dynamic musical tone with such an effect of tremolo.

According to the present invention, this object is achieved by a pan-pot control apparatus which comprises right-left and front-rear pan-pot control means, and at least two loudspeakers each connected to outputs of both pan-pot control means for sounding a musical tone which is controlled in right-left and front-rear pan-pot fashion.

DETAILED DESCRIPTION OF THE PREFERRED EMBODIMENTS

A few embodiments of the invention will now be described in detail with reference to the accompanying drawings.

Figure 1:
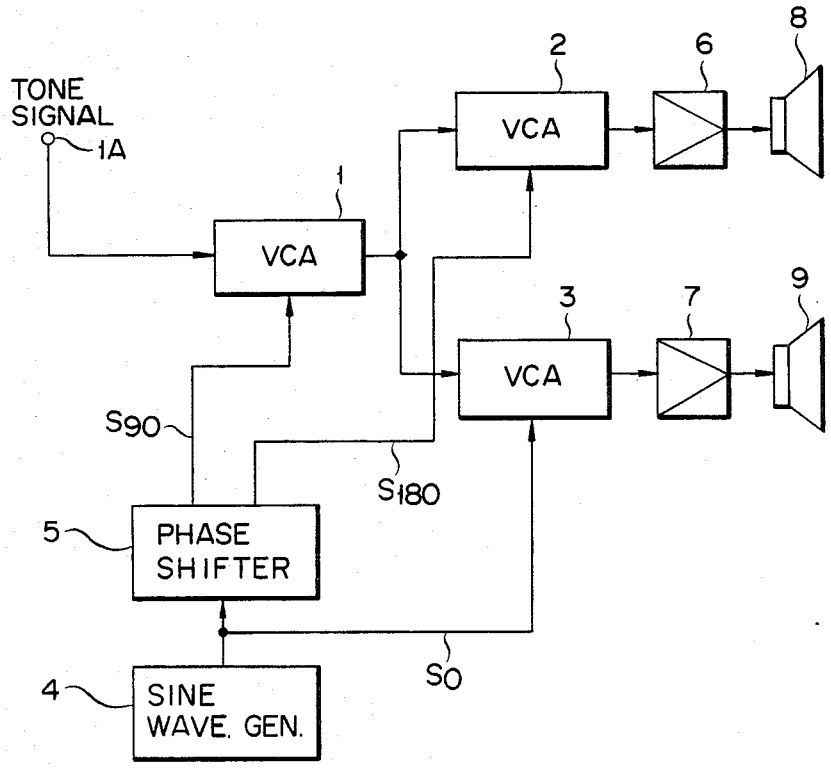
FIG. 1 is a block diagram of a first embodiment of the present invention.

FIG. 1 shows a first embodiment of the invention. A tone signal generated by a tone signal generator (not shown) is supplied to the signal input terminal of a voltage controlled amplifier (VCA) 1 via an input terminal 1A. The output signal of this amplifier 1 is input to two VCAs 2 and 3 via the signal input terminals thereof.

A sine wave signal S0 of a frequency lower than that of the tone signal is supplied from a sine wave generator 4 to the control signal input terminal of the VCA 3. The sine wave signal S0 is also supplied to a phase shifter 5.

The phase shifter 5 forms two sine wave signals S90 and S180 phase-shifted by 90° and 180° from the sine wave signal S0. The signal S90 is supplied to the control signal input terminal of the VCA 1, and the signal S180 is supplied to the control signal input terminal of the VCA 2. The output signals of the VCAs 2 and 3 are amplified by amplifiers 6 and 7 and subseqently input to a right loudspeaker 8 and a left loudspeaker 9.

Figure 3:
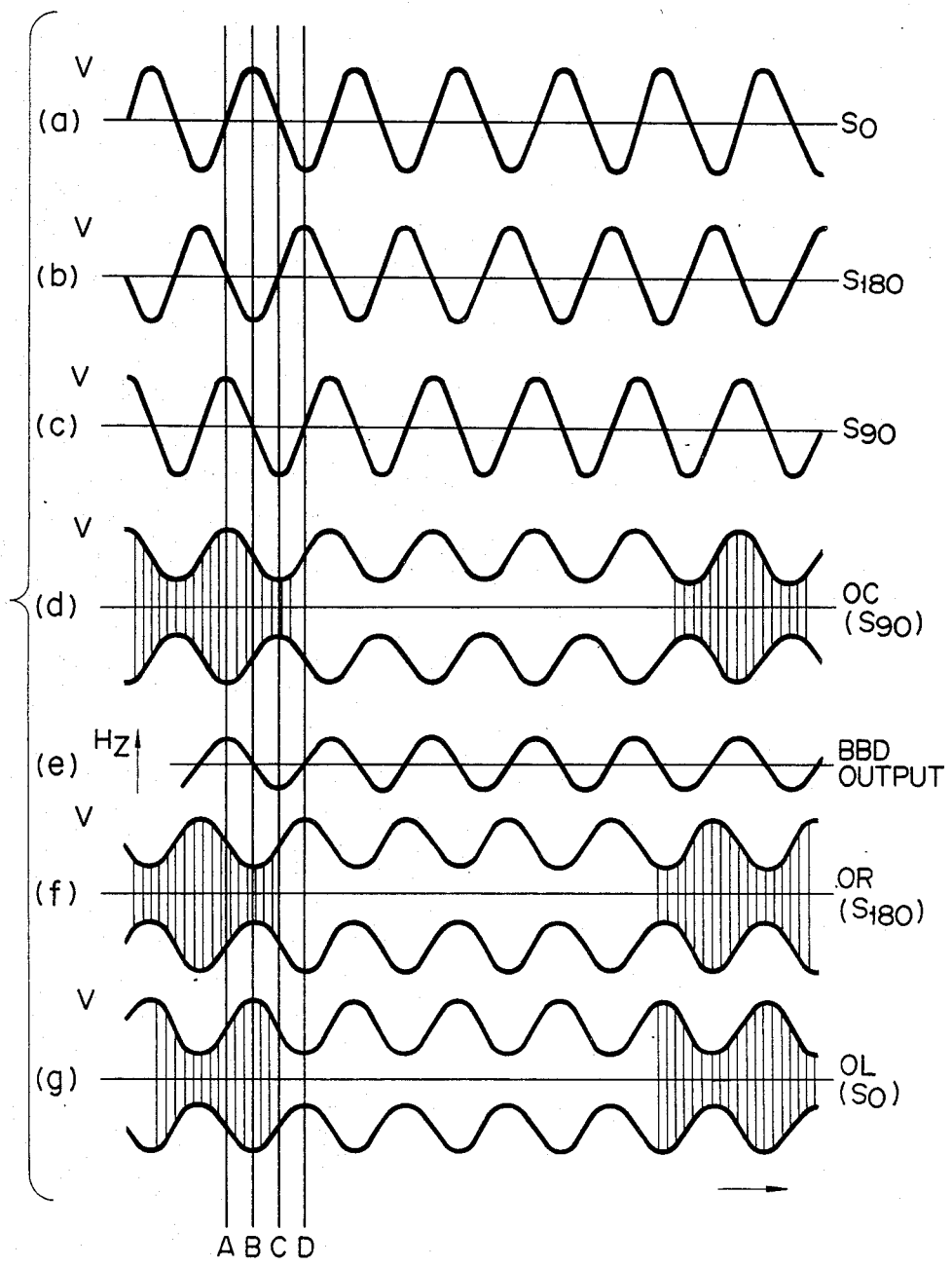
FIG. 3 shows the waveforms of signals at the various elements shown in FIG. 1 and FIG. 7.

It will now be explained how the apparatus of FIG. 1 operates. The tone envelope of the tone signal supplied to the input terminal 1A is controlled by the signal S90 supplied to the VCA 1. The output signal OC of the VCA 1 periodically changes in amplitude as shown in FIG. 3(*d*). The amplitudes of the input signals of the VCAs 2 and 3 therefore change at the same time, whereby the volume of the musical tone generated by the right and left loudspeakers 8 and 9 increases or decreases at the same time. As a result, to a listener P sitting in front of the loudspeakers 8 and 9, a musical tone sounds as if it comes from a point moving along the line crossing the line connecting the speakers 8 and 9.

The sine wave signals S180 and S0, which have a 180°-phase difference between them, are supplied to the right-side VCA 2 and left-side VCA 3, respectively. The output signals OR and OL of these VCAs 2 and 3 therefore have such envelopes shown in FIGS. 3(*f*) and 3(*g*). As these figures show, the signal OR rises to the maximum value when the signal OL falls to the minimum value, with the result that the musical tone sounds as if it comes from a point close to the right loudspeaker 8. On the other hand, the signal OL rises to its maximum value when the signal OR falls to its minimum value, with the result that the tone sounds as if it comes from a point near the left loudspeaker 9. Hence, as the VCAs 2 and 3 continuously produce output signals, the musical tone sounds as if generated from a point periodically moving between the right loudspeaker 8 and left loudspeaker 9.

The tone signal input to the VCAs 2 and 3 have the waveform shown in FIG. 3(*d*). Hence, the output signals of the VCAs 2 and 3 do not have the waveform shown in FIG. 3(*f*) or the waveform shown in FIG. 3(*g*). Rather, their waveforms are, so to speak, the combination of the waveforms shown in FIGS. 3(*d*) and 3(*f*) and the combination of the waveforms shown in 3(*d*) and 3(*g*). It follows that the position of the pan-pot of the composite musical tone which is the mixture of the tones from the loudspeakers 8 and 9, changes in a complex manner. Now, let us find where the pan-pot is located at times A, B, C and D at regular intervals which correspond to a phase difference of 90°.

At time A, the signals OR and OL have the same amplitude, and the signal OC, which determines the volume of the composite musical tone, has the maximum value. Therefore, the pan-pot is positioned at point A (FIG. 2), halfway between the loudspeakers 8 and 9 and nearest to the listener P.

At time B, the signal OR has the smallest amplitude, the signal OL has the maximum amplitude and the signal OC has a medium amplitude. Hence, the pan-pot is located at point B (FIG. 2), nearest to the left loudspeaker 9 and farther from the listener P than point A.

At time C, the signals OR and OL have the same amplitude, and the signal OC has the smallest amplitude. Accordingly, the pan-pot is located at point C (FIG. 2), halfway between the loudspeakers 8 and 9 and remotest from the listener P.

At time D, the signals OR and OL have the greatest amplitude and the smallest amplitude, respectively, and the signal OC is at the medium level. Hence, the pan-pot is located at point D (FIG. 2), nearest to the right loudspeaker 8 and farther from the listener P than point A.

Figure 2:
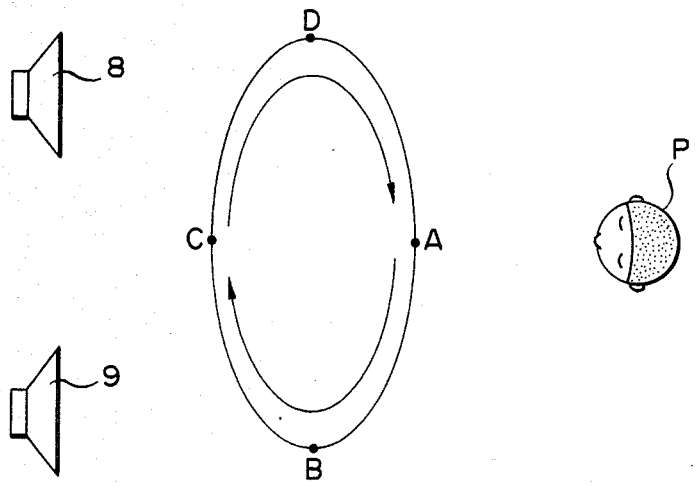
FIG. 2 illustrates how the apparatus of FIG. 1 operates.

Since the volume of the composite musical tone is so varied at intervals to move the pan-pot right and left and at the same intervals but phase-shifted by 90° to move the pan-pot back and forth, the pan-pot moves in a circle along which the listener P and loudspeakers 8 and 9 are arranged (FIG. 2). Hence, the composite musical tone sounds as if it comes from this pan-pot. The tone is therefore dynamic.

Figure 5:
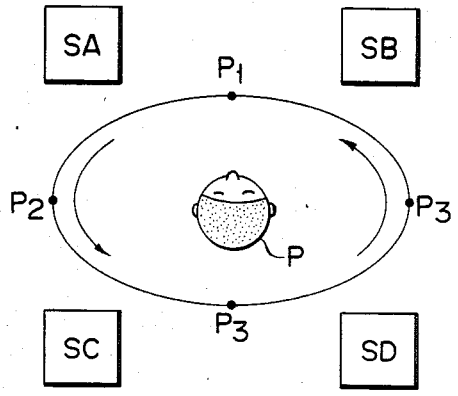
FIG. 5 explains how the apparatus of FIG. 4 operates.
Figure 4:
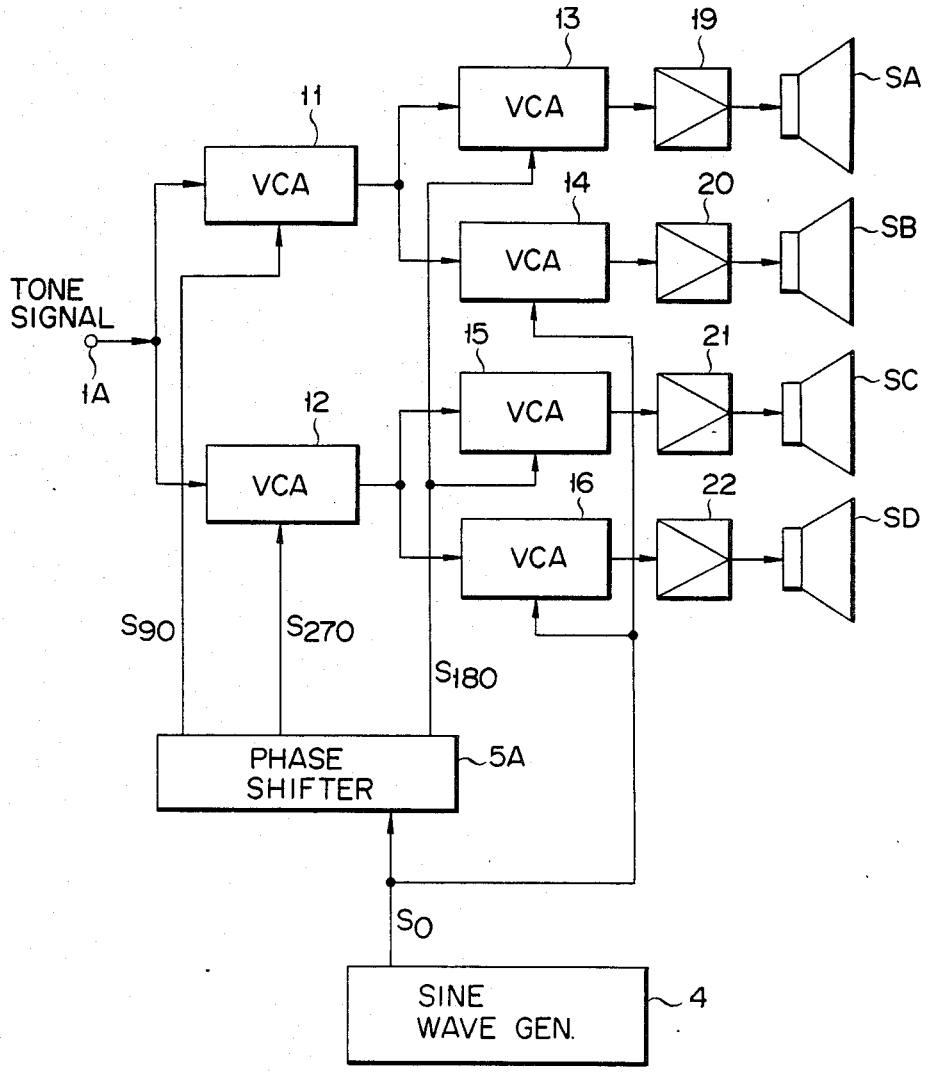
FIG. 4 is a block diagram of a second embodiment of the invention.

FIG. 4 shows a second embodiment of the invention, which uses two amplifier-loudspeaker units similar to one used in the first embodiment, each comprising three VCAs and two loudspeakers. In the second embodiment, the four loudspeakers are arranged around the listener, and the pan-pot moves around him as shown in FIG. 5.

As illustrated in FIG. 4, a tone singal supplied to an input terminal 1A is simultaneously input to first and second central VCAs 11 and 12. The output signal of the first central VCA 11 is supplied to a first right VCA 13 and a first left VCA 14 at the same time. The output signal of the second central VCA 12 is input to a second right VCA 15 and a second left VCA 16.

A sine wave signal S0 is supplied from a sine wave generator 4 to the control input terminals of the first and second left VCAs 14 and 16. This signal S0 is also input to a phase shifter 5A. The phase shifter 5A outputs sine-wave signals S90, S180 and S270 which are phase-shifted from the signal S0 by 90°, 180° and 270°, respectively. The signal S90 is supplied to the control input terminal of the first central VCA 11, the signal S180 is supplied to the control input terminals of the first and second right VCAs 13 and 15, and the signal S270 is supplied to the control input terminal of the second central VCA 12. The output signals of the VCAs 13 to 16 are amplified by amplifiers 19 to 22 and converted into musical tones by loudspeakers SA, SB, SC and SD, respectively.

Figure 6:
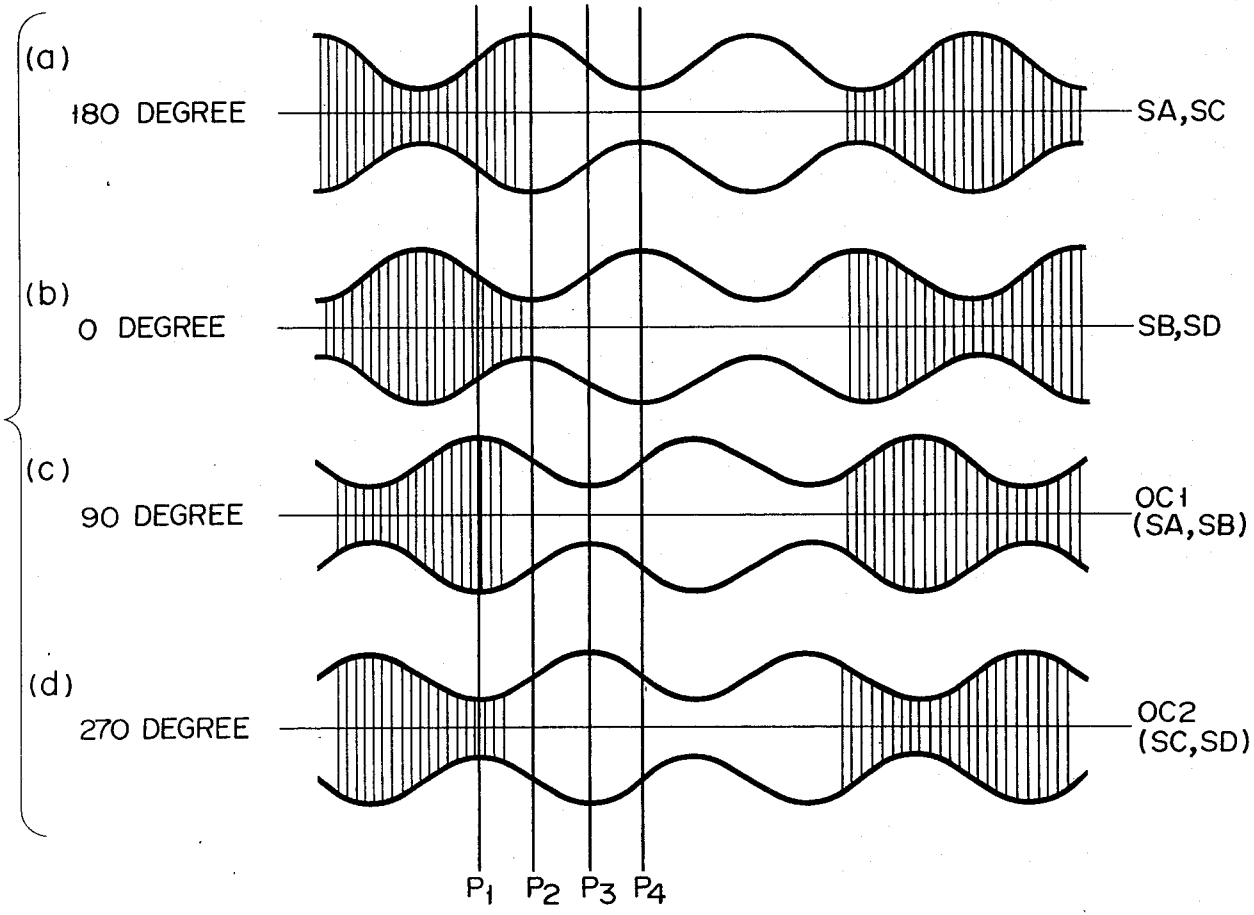
FIG. 6 shows the waveforms of the signals at the various elements shown in FIG. 4.

The operation of the second embodiment shown in FIG. 4 will now be described with reference to FIGS. 5 and 6.

When a tone signal is supplied from the input terminal 1A to the first and second central VCA 11 and 12, the sine-wave signals S90 and S270 control the amplification factors of these VCAs 11 and 12. As a result, the VCAs 11 and 12 output tone signals OC1 and OC2 whose amplitudes periodically change and which have a phase difference of 180° as shown in FIGS. 6(*c*) and 6(*d*). When tone signals which have not been envelope-controlled unlike the output signals OC1 and OC2 are supplied to the VCAs 13 to 16, the VCAs 13 and 15 output a signal as shown in FIG. 6(*a*) and the VCAs 14 and 16 produce a signal as shown in FIG. 6(*b*). Hence, when the signal OC1 is supplied to the VCAs 13 and 14 and the signal OC2 is input to the VCAs 15 and 16, the VCAs 13–16 output the following signals:

VCA 13: Combination of the signal OC1 and the signal of FIG. 6(*a*)

VCA 14: Combination of the signal OC1 and the signal of FIG. 6(*b*)

VCA 15: Combination of the signal OC2 and the signal of FIG. 6(*a*)

VCA 16: Combination of the signal OC2 and the signal of FIG. 6(*b*)

Now, let us find where the pan-pot is located at times P1, P2, P3 and P4 at regular intervals which correspond to a phase difference of 90° when the loudspeakers SA, SB are placed in front of a listener P, on the left and right, respectively, and the loudspeakers SC and SD are arranged at the back of him, on the left and right, respectively.

At time P1, the output signals of the front loudspeakers SA and SB have the same, maximum amplitude, whereas the output signals of the rear loudspeakers SC and SD have the same, minimum amplitude. Therefore, the pan-pot is positioned in front of the listener P and halfway between the loudspeakers SA and SB, as shown in FIG. 5.

At time P2, the signals OC1 and OC2 are at the same level. Hence, the output signals of the loudspeakers SA and SC have the same, maximum amplitude, whereas the output signals of the loudspeakers SB and SD have the same, minimum amplitude. The pan-pot is therefore on the left of the listener P and halfway between the loudspeakers SA and SC, as illustrated in FIG. 5.

At time P3, the signal OC1 is at the lowest level, whereas the signal OC2 is at the highest amplitude, and the output signals of the loudspeakers SA, SC and SB, SD have substantially the same amplitude. Accordingly, the pan-pot point P3 is located at the back of the listener P.

At time P4, the signals OC1 and OC2 are substantial the same level, and the output signals of the loudspeakers SB and SD have the maximum amplitude. Hence, the pan-pot position P4 is located on the right of the listener P.

In the case of the second embodiment, the pan-pot may move in a circle around the listener P. This can give the listener P a sense like a concert-hall presence.

Figure 7:
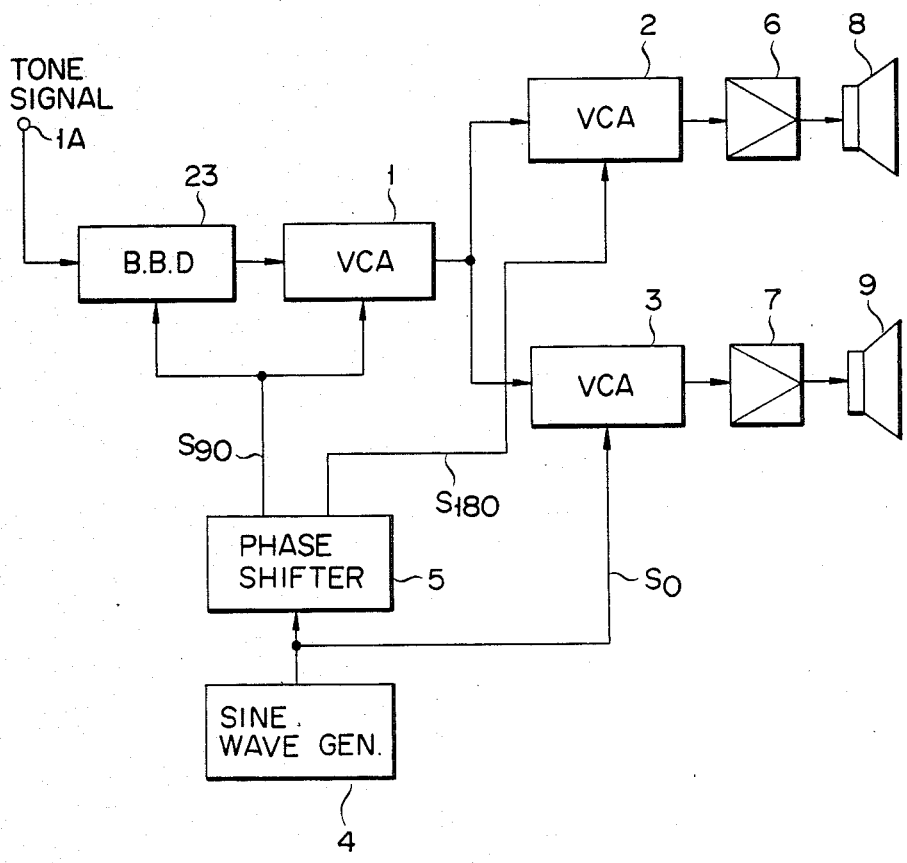
FIG. 7 is a block diagram of a third embodiment of this invention.

FIG. 7 shows a third embodiment of this invention. This embodiment is so designed as to add the Doppler effect along with the motion of the pan-pot, so that the resultant musical tone may have a toremolo chorus effect.

In FIG. 7, the same elements as those of the first embodiment (FIG. 1) are denoted by the same numerals. As shown in this figure, a tone signal input terminal 1A is coupled to the input terminal of a BBD (bucket brigade device) 23. The output of BBD 23 is connected to the input terminal of a central VCA 1. The output signal S90 of a phase shifter S90 is supplied to the control signal input terminal of the BBD 23 and also to the control signal input terminal of the central VCA 1. As the sine-wave signal S90 is input to the BBD 23, the time during which the tone signal passes through the BBD 23 (i.e. the delay time of the BBD 23) periodically changes. Accordingly, the BBD 23 outputs a signal whose frequency periodically varies as the amplitude of the sine-wave signal S90.

The operation of the third embodiment will now be explained. As is clearly understood from FIGS. 1 and 2, the third embodiment is identical in structure with the first embodiment, except that it is provided with the BBD 23. Therefore, the pan-pot of the musical tone generated by loudspeakers 8 and 9 moves exactly in the same way as shown in FIG. 2. Since the freqeuncy of the output signal of the BBD 23 periodically changes as shown in FIG. 3(*e*), the volume of the composite musical tone gradually increases due to the sine-wave signal S90. As the pan-pot moves from point C to point D and finally to point A (FIG. 2), the frequencies of the musical tones generated by the loudspeakers 8 and 9 also progressively rise. By contrast, as the pan-pot moves from point A to point B and then point C, the volume of the composite musical tone gradually decreases and, at the same time, the frequencies of the tones produced by the loudspeakers 8 and 9 gradually fall.

Consequently, the composite musical tone becomes higher as the pan-pot moves toward the listener P, and it become lower as the pan-pot moves away from him. This Doppler effect gives the listener P not only a sense like a concert-hall presence but also a toremolo chorus effect.

The present invention may be reduced to practice in the following modes.

(1) In the first, second and third embodiments, the sine-wave signals supplied to the VCAs have the same amplitude. Instead, the signals S0, S90, S180 and S270 may have different amplitudes. If they have different amplitudes, it will be possible to move the pan-pot back and forth for a longer distance than to move it the left and right, or to move it left and right for a longer distance than to move it back and forth. The phase difference between the sine-wave signals is not limited to 90°.

(2) In the above embodiments, the amplification factor control signal input to each VCA is a sine-wave signal. Instead, a triangular wave signal, sawtooth wave signal, rectangular wave signal, or trapezoidal wave signal may be used, so that the pan-pot may move in a diamond shape, in a square shape, along an arc, or in a zigzag. Also in this case, a signal identical with the one input to the central VCA 1 (the third embodiment) is supplied to the BBD 23.

(3) In the above embodiments, the loudspeakers 8 and 9 and the loudspeakers SA, SB, SC and SD are arranged on the same horizontal plane. Instead, they may be arranged at different levels so that the pan-pot may move in a vertical plane or an inclined plane.

(4) In the above embodiments, the sine-wave signals input to the VCAs have exactly the same frequency. These signals may have slightly different frequencies, instead, so that the pan-pot may move first in an ellipse and then in a circle, and so forth.

(5) In the above embodiments, the volume of the composite musical tone is controlled by only the central VCA. This VCA may be replaced by a device which superposes the signal S90 on the signals S180 and S0 and supplies the composite signal, S90+S180, to the right-side VCA and the composite signal, S90+S0, to the left-side VCA. Also in this case, the pan-pot can move back and forth.

(6) Instead of the measures stated in paragraph (5), two signals with a 90°-phase difference may be supplied to the right and left VCAs, respectively. In this case, too, the pan-pot can move back and forth.

(7) Three or more loudspeakers may be arranged in front of the listener, and the signals to be input to these VCAs may be so controlled that the pan-pot move around the VCAs and the volume of the composite musical tone varies, whereby the tone sounds as if coming from a point moving in a spiral.

As mentioned above, in the present invention, the signals to be input to the loudspeakers are so controlled that the pan-pot moves in a circle, along a square shape or the like, not merely moving along a line. The composite signals made up of the tones generated by the loudspeakers therefore sounds dynamic. Further, a toremolo chorus effect is added to the composite musical tone by changing the frequencies of the tones produced by the loudspeakers.

What is claimed is:

1. A pan-pot control apparatus comprising:

an input terminal connected to receive an input tone signal;

pan-pot control means connected to receive said input tone signal for moving a pan-pot left and right and front and rear, the pan-pot control means including:

a first amplitude control means for periodically changing the amplitude of said input tone signal at the first phase.

a second amplitude control means for periodically changing the amplitude of the output signal of the first amplitude control means at a second phase different by about 90 degrees from the first phase, and a third amplitude control means for periodically changing the amplitude of the output signal of the first amplitude control means at a third phase different by about 180 degrees from the second phase; and at least two loudspeakers connected to receive output signals of said pan-pot control means for sounding a tone which is controlled in right-left and front-rear pan-pot fashion.

2. The appparatus of claim 1, wherein said first, second and third amplitude control means respectively have control input terminals to receive a first sine-wave signal in phase with the output signal of said first amplitude control means, a second sine-wave signal with about a 90 degrees phase difference from the first sine-wave signal and a third sine-wave signal with about a 180 degrees phase difference from the second sine-wave signal.

3. The apparatus of claim 2, wherein said sine-wave signals have a frequency lower than that of said input tone signal.

4. The apparatus of claim 1, wherein said pan-pot control means further includes a frequency control means for raising the frequency of the input tone signal when the pan-pot is moving to the front, and for lowering the frequency of the input tone signal when the pan-pot is moving to the rear.

5. The apparatus of claim 4, wherein said frequency control means includes a bucket brigade device and means for controlling the speed at which a tone signal passes through the bucket brigade device as the pan-pot moves front and rear.

6. The apparatus of claim 1, wherein each of said amplitude control means comprises a voltage controlled amplifier means.

7. The apparatus of claim 1, wherein said input tone signal is a single tone signal.

8. A pan-pot control apparatus comprising:

an input terminal connected to receive an input tone signal;

pan-pot control means connected to receive said input tone signal for moving a pan-pot left and right and front and rear, the pan-pot control means including:

a first amplitude control means for periodically changing the amplitude of said input tone signal at a first phase, a second amplitude control means for periodically changing the amplitude of the output signal of the first amplitude control means at a second phase different by about 90 degrees from the first phase, a third amplitude control means for periodically changing the amplitude of the output signal of the first amplitude control means at a third phase different by about 180 degrees from the second phase, a fourth amplitude control means for periodically changing the amplitude of said input tone signal at a fourth phase different by about 180 degrees from the first phase, a fifth amplitude control means for periodically changing the amplitude of the output signal of the fourth amplitude control means at the second phase, and a sixth amplitude control means for periodically changing the amplitude of the output signal of the fourth amplitude control means at the third phase; and four loudspeaker means connected to receive output signals of said pan-pot control means for sounding a tone which is controlled in right-left and front-rear pan-pot fashion, the four loudspeaker means including, a first loudspeaker means coupled to receive an output of said second amplitude control means, a second loudspeaker means coupled to receive an output of said third amplitude control means, a third loudspeaker means coupled to receive an output of said fifth amplitude control means, and a fourth loudspeaker means coupled to receive an output of said sixth amplitude control means.

9. The apparatus of claim 8, wherein each of said amplitude control means comprises a voltage controlled amplifier means.

10. The apparatus of claim 8, wherein said first to sixth amplitude control means respectively have control input terminals to receive a first sine-wave signal in phase with the output signal of said first amplitude control means, a second sine-wave signal with about a 90 degrees phase difference from said first sine-wave signal, a third sine-wave signal with about a 180 degrees phase difference from said first sine-wave signal, a third sine-wave signal with about a 180 degrees phase difference from the second sine-wave signal, a fourth sine-wave signal with about a 180 degrees phase difference from said first sine-wave signal, a fifth sine-wave signal which is a same wave signal with said second sine-wave signal, and a sixth sine-wave signal which is a same wave signal with said third sine-wave signal.

11. The appatatus of claim 10, wherein said frequency control means includes a bucket brigade device and means for controlling the speed at which a tone signal passes through the bucket brigade device as the pan-pot moves front and rear.

12. The apparatus of claim 10, wherein said sine-wave signals have a frequency lower than that of said input tone signal.

13. The apparatus of claim 8, wherein said pan-pot control means further includes a frequency control means for raising the frequency of the input tone signal when the pan-pot is moving to the front, and for lowering the frequency of the input tone signal when the pan-pot is moving to the rear.

14. The apparatus of claim 13, wherein said frequency control means includes a bucket brigade device and means for controlling the speed at which a tone signal passes through the bucket brigade device as the pan-pot moves front and rear.

15. The apparatus of claim 8, wherein said input tone signal is a single tone signal.

16. A pan-pot control apparatus, comprising:

a single input terminal connected to receive an input tone signal;

a pan-pot control means for controlling a pan-pot of the input tone signal, said pan-pot control means including:

a first pan-pot control means;

a second pan-pot control means;

said first pan-pot control means being a left-right or a front-rear pan-pot controller, and said second pan-pot control means being the other of said left-right or said front-rear pan-pot controller, said single input terminal being coupled to an input of only said first pan-pot control means and not to said second pan pot control means, an input of said second pan-pot control means being coupled to an input of said first pan pot control means, and said second pan-pot control means having two outputs; and two loudspeaker means connected respectively to said outputs of said second pan-pot control means for sounding a tone which is controlled in right-left and front-rear pan-pot fashion using two loudspeaker means.

17. The apparatus of claim 16, wherein said pan-pot control means further includes a frequency control means for raising the frequency of the input tone signal when the pan-pot is moving to the front, and for lowering the frequency of the input tone signal when the pan-pot is moving to the rear.

18. The apparatus of claim 16, wherein said frequency control means includes a bucket brigade device and means for controlling the speed at which a tone signal passes through the bucket brigade device as the pan-pot moves front and rear.

19. The apparatus of claim 16, wherein each of said amplitude control means comprises a voltage controlled amplifier means.

20. The apparatus of claim 16, wherein said input tone signal is a single tone signal.

21. The apparatus of claim 16, wherein said first pan-pot control means is a left-right pan-pot control means, and said second pan-pot control means is a front-rear pan-pot control means.

22. A pan-pot control apparatus comprising:

an input terminal connected to receive an input tone signal;

a single sine-wave signal generating means for generating a first sine-wave signal at a first phase;

a phase shifter means coupled to said single sine-wave signal generating means for shifting the phase of said first sine-wave signal to produce first, second, third, and fourth sine wave signals, said second sine-wave signal being at a second phase different by substantially 90 degrees from the first phase, said third sine-wave singal being at a third phase different by substantially 180 degrees from the first phase, and said fourth sine wave singal being at a fourth phase different by substantially 270 degrees from the first phase;

pan-pot control means connected to receive said input tone signal for moving a pan-pot left and right and front and rear, said pan-pot control means including:

a first amplitude control means for periodically changing the amplitude of said input tone signal as a function of said second sine-wave signal, a second amplitude control means for periodically changing the amplitude of the output signal of the first amplitude control means as a function of third sine-wave signal, a third amplitude control means for periodically changing the amplitude of the output signal of the first amplitude control means as a function of said first sine-wave signal, a fourth amplitude control means for periodically changing the amplitude of said input tone signal as a function of said fourth sine-wave signal, a fifth amplitude control means for periodically changing the amplitude of the output signal of the fourth amplitude control means as a function of said third sine-wave signal, and a sixth amplitude control means for periodically changing the amplitude of the output signal of the fourth amplitude control means as a function of said first sine wave signal; and four loudspeaker means connected to receive output signals of said pan-pot control means for sounding a tone which is controlled in right-left and front-rear pan-pot fashion, the four loudspeaker means including, a first loudspeaker means coupled to receive an output of said second amplitude control means, a second loudspeaker means coupled to receive an output of said third amplitude control means, a third loudspeaker means coupled to receive an output of said fifth amplitude control means, and a fourth loudspeaker means coupled to receive an output of said sixth amplitude control means.

23. An apparatus according to claim 22, wherein said pan-pot control means further includes a frequency control means for raising the frequency of the input tone signal when the pan-pot is moving to the front and lowering the frequency of the input tone signal when the pan-pot is moving to the rear.

24. An apparatus according to claim 23, wherein said frequency control means includes a bucket brigade device, and means for controlling the speed at which a tone signal passes through the bucket brigade device as the pan-pot moves front and rear.

25. The apparatus of claim 22, wherein each of said amplitude control means comprises a voltage controlled amplifier means.

26. The apparatus of claim 22, wherein said input tone signal is a single tone signal.

27. The apparatus of claim 22, wherein said sine-wave signals have a frequency lower than that of said input tone signal.

* * * * *